US008616917B2

(12) United States Patent
Teng

(10) Patent No.: US 8,616,917 B2
(45) Date of Patent: Dec. 31, 2013

(54) PANEL MODULE AND POWER INPUT CONNECTOR FIXING STRUCTURE THEREOF

(75) Inventor: Ching-Chou Teng, Taipei (TW)

(73) Assignee: Inventec Corporation, Taipei (TW)

( * ) Notice: Subject to any disclaimer, the term of this patent is extended or adjusted under 35 U.S.C. 154(b) by 83 days.

(21) Appl. No.: 13/338,853

(22) Filed: Dec. 28, 2011

(65) Prior Publication Data

US 2013/0078854 A1 Mar. 28, 2013

(30) Foreign Application Priority Data

Sep. 26, 2011 (TW) ..... 100134582 A

(51) Int. Cl.
*H01R 13/60* (2006.01)

(52) U.S. Cl.
USPC ..... 439/570; 439/607.35; 439/939

(58) Field of Classification Search
USPC ..... 439/570, 573, 563, 564, 939, 607.35
See application file for complete search history.

(56) References Cited

U.S. PATENT DOCUMENTS 6,132,253 A * 10/2000 Wu ..... 439/607.19
6,312,267 B1 * 11/2001 Wang ..... 439/92
6,398,587 B1 * 6/2002 Chen et al. ..... 439/607.35
6,533,612 B1 * 3/2003 Lee et al. ..... 439/564
7,686,646 B2 * 3/2010 Lee et al. ..... 439/567

* cited by examiner

*Primary Examiner* — Hien Vu
(74) *Attorney, Agent, or Firm* — WPAT, PC; Justin King

(57) ABSTRACT

A fixing structure used for fixing a power input connector on a bracket is provided. The power input connector includes a socket body and a notch part. The fixing structure includes first and second fixing elements. The first fixing element has a first coupling portion and an opening. The second fixing element has a second coupling portion coupled to the first coupling portion, and a supporting portion connected with the notch part to fix the power input connector. The first fixing element covers the second fixing element and the power input connector, and the socket body is exposed from the opening. First and second fixing elements are fixed on the bracket to provide a first supporting force to balance a first force pulling the power input connector away from the bracket, and a second supporting force to balance a second force pressing the power input connector towards the bracket.

4 Claims, 3 Drawing Sheets

PANEL MODULE AND POWER INPUT CONNECTOR FIXING STRUCTURE THEREOF

This application claims the benefit of Taiwan application Serial No. 100134582, filed Sep. 26, 2011, the subject matter of which is incorporated herein by reference.

BACKGROUND OF THE INVENTION

1. Field of the Invention

The invention relates in general to a power input connector fixing structure, and more particularly to a fixing structure for fixing a power input connector on a panel.

2. Description of the Related Art

Along with the development and advance in technology, the all in one (AIO) computer which integrates the functions of display and computer has gradually become a mainstream product in the market. Currently, the power input connector (DC-in jack) of the AIO computer has two types: the first type of power input connector supplies 180 Watts (W) of power, and the second type of power input connector provides 120 W of power. The shapes and structures for the two types of power input connectors with different types are also different.

When assembling the power input connector to the panel bracket, due to the different types of the power input connector, the panel bracket needs to be selected for matching the power input connector when performing element positioning. Thus, for assembling a power input connectors to a panel brackets, different types of panel brackets matching different types of power input connectors need to be manufactured, not only making the assembly process complicated but also increasing the manufacturing cost.

SUMMARY OF THE INVENTION

The invention is directed to a power input connector fixing structure which enables the power input connector to bear the forces applied by the user when pulling or pressing the connector in different directions. Furthermore, the power input connectors with different types can be firmly assembled on the same panel bracket by one of the fixing elements of the fixing structure.

According to a first aspect of the present invention, a fixing structure used for fixing a power input connector on a bracket is provided. The power input connector includes a socket body and a notch part. The fixing structure includes a first fixing element and a second fixing element. The first fixing element has a first coupling portion and an opening. The second fixing element has a second coupling portion and a supporting portion. The second coupling portion is coupled to the first coupling portion. The supporting portion is connected with the notch part to fix the power input connector. The first fixing element covers the second fixing element and the power input connector, and the socket body is exposed from the opening. The first and the second fixing elements are fixed on the bracket to provide a first supporting force to balance a first force applied by the user when pulling the power input connector away from the bracket and provide a second supporting force to balance a second force applied by the user when pressing the power input connector toward the bracket.

According to a second aspect of the present invention, a panel module including a power input connector, a panel, a panel bracket and a fixing structure is provided. The power input connector including a socket body and a notch part. The panel bracket is disposed on the panel. The fixing structure is used for fixing a power input connector on the panel bracket. The fixing structure includes a first fixing element and a second fixing element. The first fixing element has a first coupling portion and an opening. The second fixing element has a second coupling portion and a supporting portion. The second coupling portion is coupled to the first coupling portion. The supporting portion is connected with the notch part to fix the power input connector. The first fixing element covers the second fixing element and the power input connector and the socket body is exposed from the opening. The first and the second fixing elements are fixed on the bracket to provide a first supporting force to balance a first force applied by the user when pulling the power input connector away from the bracket, and a second supporting force to balance a second force applied by the user when pressing the power input connector toward the bracket.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
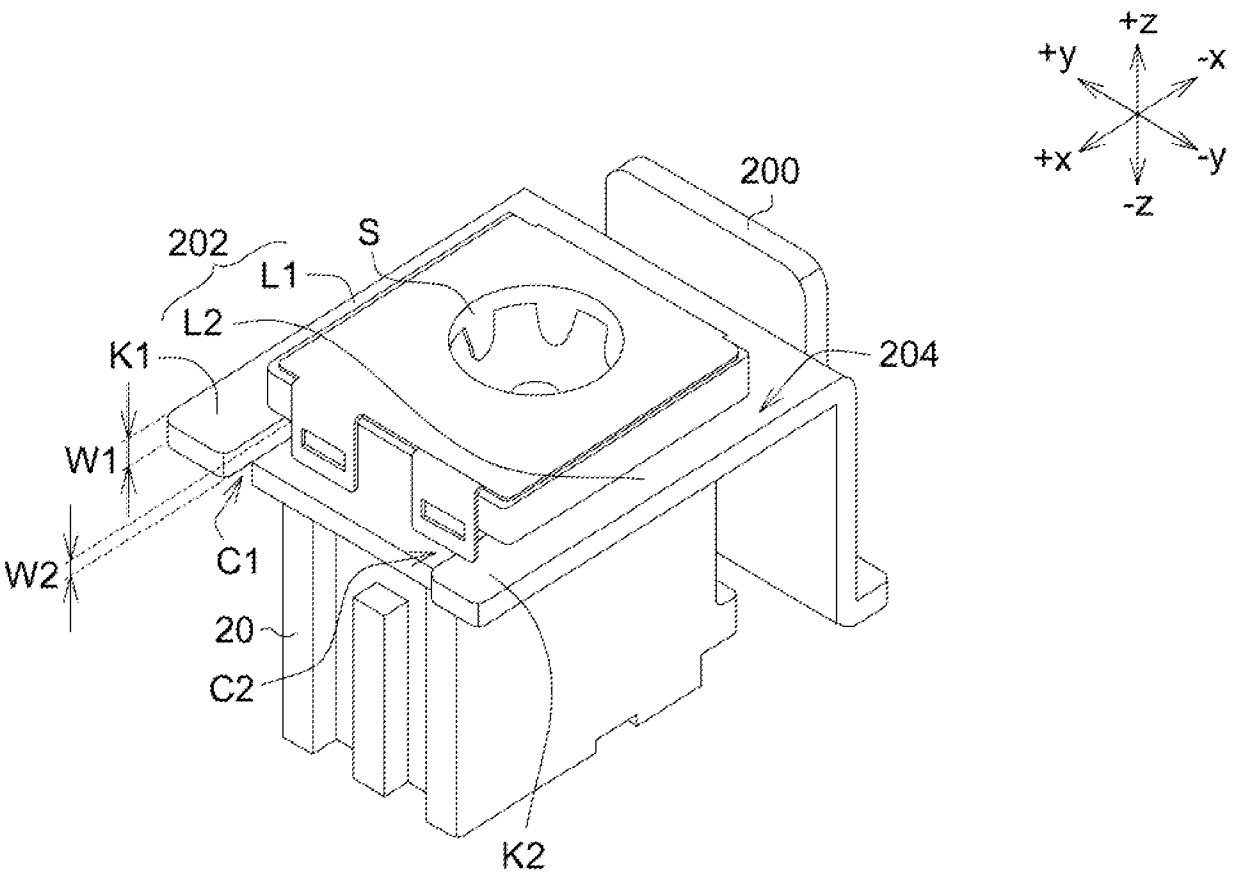
FIG. 1 shows a structural diagram of a fixing element and a power input connector coupled together according to one embodiment of the invention.

Referring to FIG. 1, a structural diagram of a fixing element 200 and a power input connector 20 coupled together according to one embodiment of the invention is shown. As indicated in FIG. 1, the fixing element 200 includes a supporting portion 202 and a coupling portion 204. The power input connector 20 includes a notch part C1, a notch part C2 and a socket body S. Preferably, the supporting portion 202 includes a strip L1 and a strip L2. The thickness of the strip L1 is W1, and the width of the notch part C1 is W2. The value of the thickness W1 is substantially larger than or equal to that of the width W2, such that the strip L1 can be tightly coupled to the notch part C1. The socket bodies C1 and C2 are disposed in symmetry, and so are the strips L1 and L2 disposed in symmetry. When the strip L1 is coupled to the notch part C1 and the strip L2 is coupled to the notch part C2, the socket body S is exposed from one side of the coupling portion 204.

In the present embodiment, the supporting portion 202 of the fixing element 200 is coupled to the notch part C1 and the notch part C2 of the power input connector 20 to provide a supporting force to balance a first force applied by the user when pressing the power input connector 20 towards the −z-axis direction and provide another supporting force to balance a second force applied by the user when pulling the power input connector 20 away from the +z-axis direction. In the present embodiment, a hook K1 is extended from one end of the strip L1 and a hook K2 is extended from one end of the strip L2, such that the hook K1 and the hook K2 tightly press a surface of the power input connector 20 when the strip L1 is coupled to the notch part C1 and the strip L2 is coupled to the notch part C2.

Figure 2:
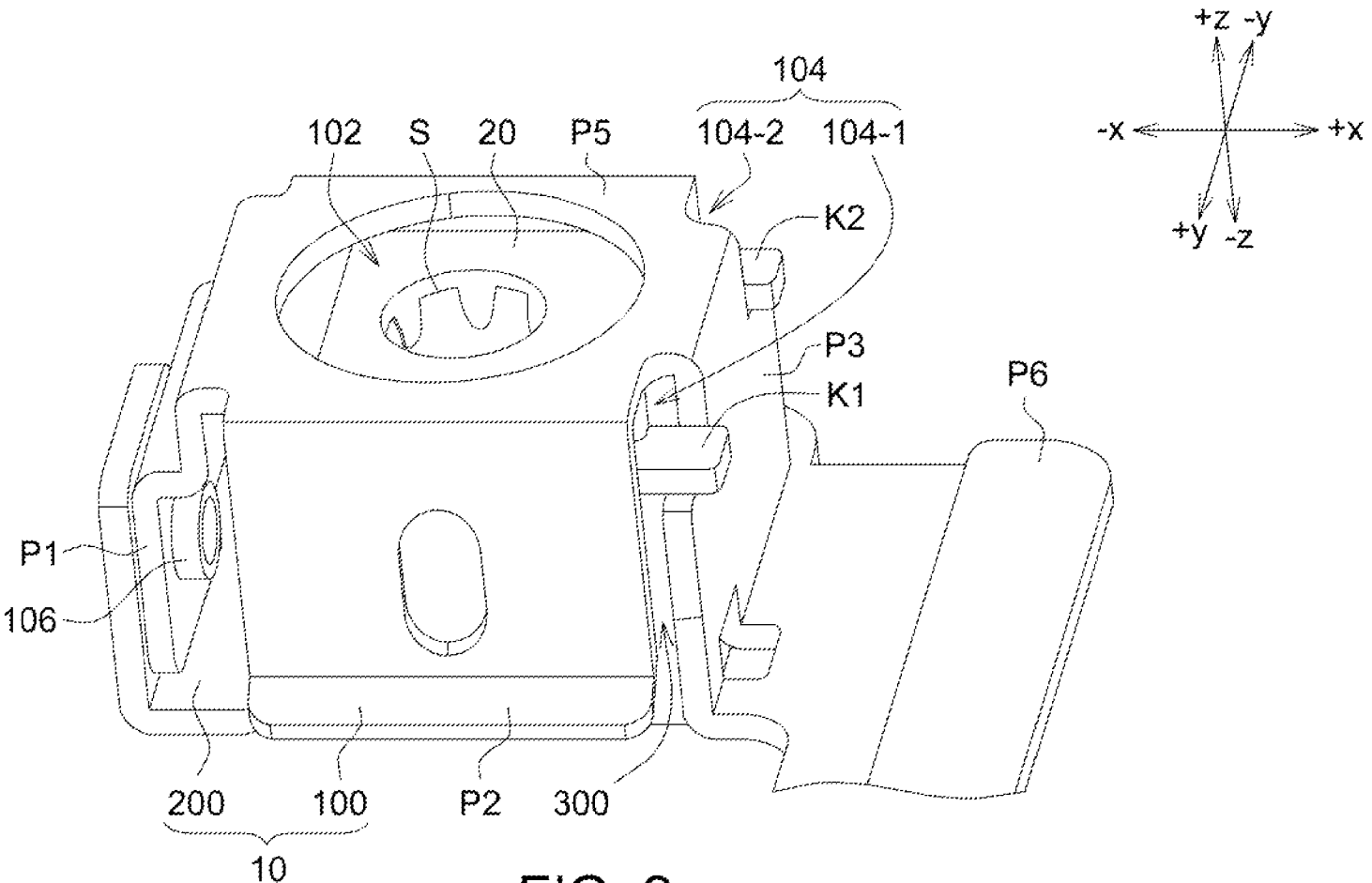
FIG. 2 shows a structural diagram of a fixing structure and a power input connector coupled together according to one embodiment of the invention.

Referring to FIG. 2, a structural diagram of a fixing structure 10 and a power input connector 20 coupled together according to one embodiment of the invention is shown. As indicated in FIG. 2, the fixing structure 10 includes a fixing element 100 and a fixing element 200. An accommodation space 300 is formed by the fixing element 100 and the fixing element 200 for receiving the power input connector 20. The fixing element 100 includes an opening 102 and a coupling portion 104. The coupling portion 104 may include a coupling recess 104-1 and a coupling recess 104-2.

Figure 3:
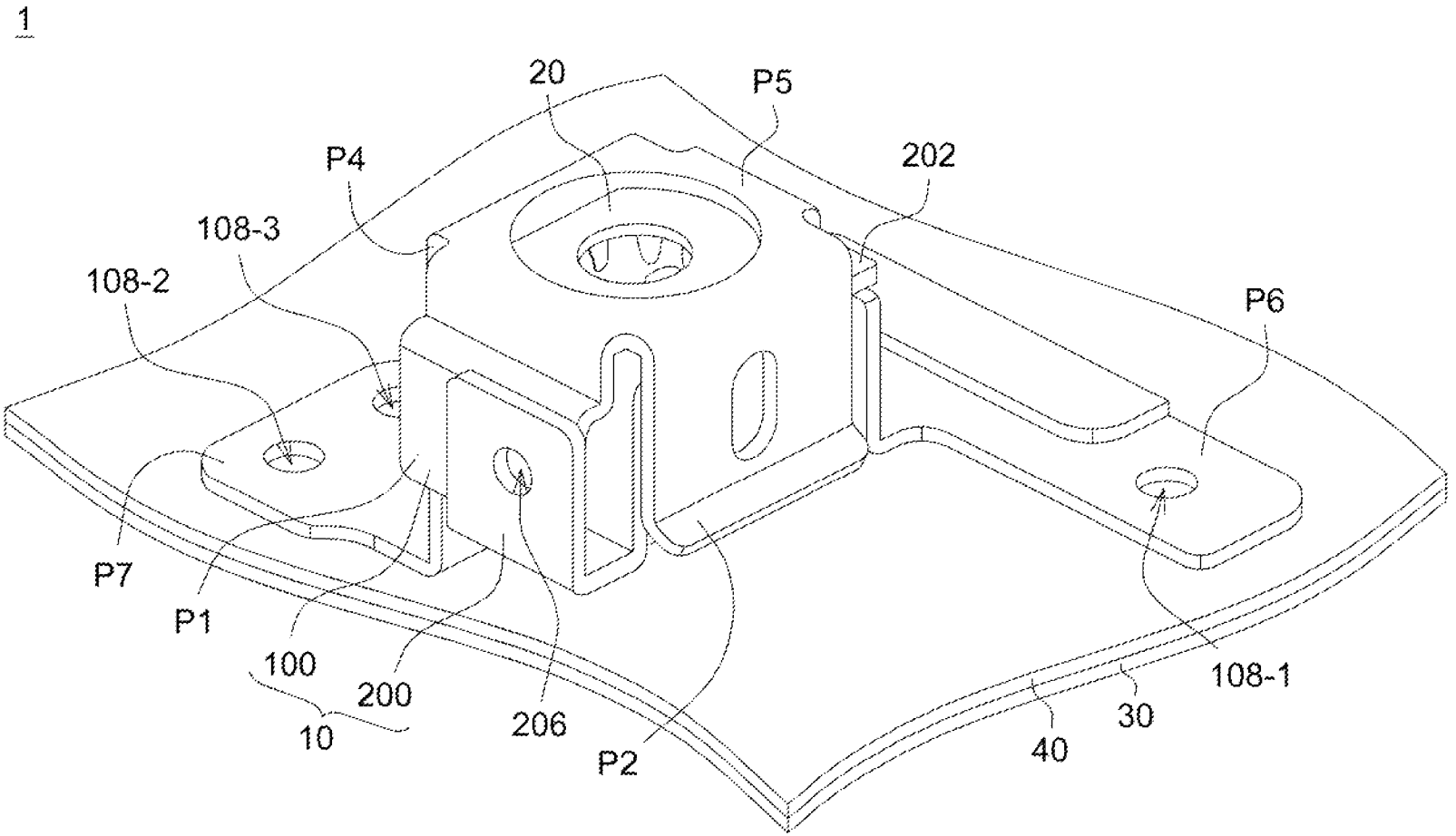
FIG. 3 shows a schematic diagram of a panel module according to one embodiment of the invention.

As indicated in FIG. 2, fixing element 100 includes plates P1, plates P2, plates P3, plates P4 (illustrated in FIG. 3), plates P5, plates P6 and plates P7 (illustrated in FIG. 3). The plate P1 is substantially perpendicular to the plate P5 and has a plane normal vector whose direction is the −x-axis direction. The plate P1 has an hole 106. The plate P5 and the plate P6 are substantially parallel to each other and each has a plane normal vector whose direction is the +z-axis direction. The plate P2 is substantially perpendicular to the plate P1 and has a plane normal vector whose direction is the +y-axis direction. The plate P3 is substantially perpendicular to the plate P5 and has a plane normal vector whose direction is the +x-axis direction. The plate P4 (illustrated in FIG. 3) is substantially perpendicular to the plate P5 and has a plane normal vector whose direction is the −y-axis direction.

In the present embodiment, when the fixing element 100 covers the power input connector 20 and the fixing element 200 coupled together as indicated in FIG. 1, the supporting portion 202 and the coupling portion 204 of the fixing element 200 are coupled to the coupling portion 104 of the fixing element 100. To put it in greater details, the hook K1 and the hook K2 can be respectively coupled to the coupling recess 104-1 and the coupling recess 104-2 of the coupling portion 104. Meanwhile, the socket body S is exposed from the opening 102.

In the present embodiment, after assembly is completed, the fixing structure 10 provides a supporting force through the plate P5 of the fixing element 100 to balance a second force applied by the user when pulling the power input connector 20 away from the +z-axis direction. In addition, the power input connector 20 being enclosed and surrounded by the plates P1~P4 of the fixing element 100 will not move in the y-axis direction or the z-axis direction. Furthermore, the power input connector 20 can be firmly fixed in the accommodation space 300 by the fixing element 100 and the fixing element 200, such that the power input connector 20 can bear the force applied by the user when pulling the power input connector 20 in the z-axis direction.

Referring to FIG. 3, a schematic diagram of a panel module according to one embodiment of the invention is shown. The panel module 1 includes a fixing structure 10, a power input connector 20, a panel 30 and a panel bracket 40. For the convenience of elaboration, details of the panel module 1 are omitted. As indicated in FIG. 3, the plate P7 of the fixing element 100 is substantially parallel to the plate P6. In the present embodiment, the plate P6 has a fixing hole 108-1, and the plate P7 has a fixing hole 108-2 and a fixing hole 108-3. The second fixing element 200 has an hole 206. After the power input connector 20 is coupled to the supporting portion 202 and the fixing element 100 is mounted on the power input connector 20 and the fixing element 200, the position of the hole 206 of the fixing element 200 corresponds to that of the hole 106 (illustrated in FIG. 2) of the fixing element 100. Then, other positioning elements (not illustrated in the diagram), such as screws, can pass through the hole 206 of the fixing element 200 and the hole 106 of the fixing element 100 to fix the fixing element 100 and the fixing element 200. By performing the above steps, the power input connector 20, the fixing element 100 and the fixing element 200 can thus be assembled together.

As indicated in FIG. 3, after the fixing structure 10 and the power input connector 20 are assembled together, the positioning element (not illustrated in the diagram), such as screws, can pass through at least one of the fixing hole 108-1, the fixing hole 108-2 and the fixing hole 108-3 to mount and fix the fixing structure 10 on the panel bracket 40. In the present embodiment, the fixing element 100 preferably has three fixing holes 108-1, 108-2 and 108-3. Thus, the fixing structure 10 can be mounted on the panel bracket 40 by three positioning elements.

After the fixing structure 10 is assembled to the panel module 1, the fixing element 100 and the fixing element 200 provide a supporting force to balance a first force applied by the user when pressing the power input connector 20 towards the panel bracket 40. In addition, the fixing element 100 and the fixing element 200 provide another supporting force to balance a second force applied by the user when pulling the power input connector 20 away from the panel bracket 40.

The fixing element 100 and the fixing element 200 of the fixing structure 10 disclosed in the above embodiments of the invention provide supporting forces to the power input connector 20 in different directions, such that the power input connector 20 can be firmly fixed on the panel bracket 40. Being fixed by the fixing structure 10, the power input connector 20 can bear the forces applied by the user when pulling or pressing the connector in different directions. Moreover, the power input connector 20 can be mounted on the same panel bracket 40 by the fixing element 100 of the fixing structure 10, despite the power input connector can have different types. By using the fixing structure 10 disclosed in the above embodiments of the invention, the panel bracket 40 does not need to be selected for matching the type of the power input connector 20 for positioning the power input connector 20, hence unifying the type of the panel bracket and reducing the cost for assembling the power input connector and the panel. Therefore, the complicated assembly process in which the panel bracket needs to be selected for matching the type of the power input connector is avoided, and the manufacturing cost is reduced accordingly.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A fixing structure used for fixing a power input connector on a bracket, wherein the power input connector comprises a socket body and a notch part along a side wall thereof, and the fixing structure comprises:

a first fixing element having a first coupling portion, a first hole and an opening; and a second fixing element having a second coupling portion, a second hole and a supporting portion, wherein the second coupling portion and the supporting portion are integral with each other, the second coupling portion is coupled to the first coupling portion, the supporting portion is engaged with the notch part to fix the power input connector, and the second hole disposed corresponding to the first hole, such that after the first fixing element is coupled to the second fixing element, the position of the second hole substantially aligns with the first hole and the socket body;

wherein, the first fixing element covers the second fixing element and the power input connector, and the socket body is exposed from the opening, the first fixing element and the second fixing element are fixed on the bracket, and the first and the second fixing elements provide a first supporting force to balance a first force pulling the power input connector away from the bracket and provide a second supporting force to balance a second force pressing the power input connector toward the bracket.

2. The fixing structure according to claim 1, wherein the supporting portion is a strip, and the notch part comprises a slot, a width of the slot matches the thickness of the strip to make the strip coupled to the slot.

3. A panel module, comprising:

a power input connector comprising a socket body and a notch part along a side wall thereof;

a panel;

a panel bracket disposed on the panel; and a fixing structure used for fixing a power input connector on the panel bracket, wherein the fixing structure comprises:

a first fixing element having a first coupling portion, a first hole and an opening; and a second fixing element having a second coupling portion, a second hole and a supporting portion, wherein the second coupling portion and the supporting portion are integral with each other, the second coupling portion is coupled to the first coupling portion, the supporting portion is engaged with the notch part to fix the power input connector, and the second hole disposed corresponding to the first hole, such that after the first fixing element is coupled to the second fixing element, the position of the second hole substantially aligns with the first hole and the socket body;

wherein, the first fixing element covers the second fixing element and the power input connector, and the socket body is exposed from the opening, the first fixing element and the second fixing element are fixed on the panel bracket, and the first and the second fixing elements provide a first supporting force to balance a first force pulling the power input connector away from the bracket and provide a second supporting force to balance a second force pressing the power input connector toward the bracket.

4. The panel module according to claim 3, wherein the supporting portion is a strip, and the notch part comprises a slot, a width of the slot matches the thickness of the strip to make the strip coupled to the slot.

* * * * *